United States Patent [19]

Higgins

[11] 4,418,324

[45] Nov. 29, 1983

[54] IMPLEMENTATION OF A TUNABLE TRANSMISSION ZERO ON TRANSMISSION LINE FILTERS

[75] Inventor: Robert J. Higgins, Sunrise, Fla.

[73] Assignee: Motorola, Inc., Schaumburg, Ill.

[21] Appl. No.: 336,475

[22] Filed: Dec. 31, 1981

[51] Int. Cl.[3] ..... H01P 1/203; H01P 7/08; H01P 3/08

[52] U.S. Cl. ..... 333/204; 333/205; 333/219; 333/246

[58] Field of Search ..... 333/202–212, 333/219, 222–223, 245–246

[56] References Cited

U.S. PATENT DOCUMENTS

| | | | |
|---|---|---|---|
| 3,348,173 | 10/1967 | Matthaei et al. | 333/204 |
| 3,534,301 | 10/1970 | Golembeski | 333/204 |
| 3,539,953 | 11/1970 | Jones | 333/205 |
| 3,617,954 | 11/1971 | Levy | 333/204 |
| 4,020,429 | 4/1977 | Bickley | 333/205 |
| 4,157,517 | 6/1979 | Kneisel et al. | 333/205 |
| 4,179,673 | 12/1979 | Nishikawa et al. | 333/204 |
| 4,180,787 | 12/1979 | Pfitzenmaier | 333/212 |
| 4,266,206 | 5/1981 | Bedard et al. | 333/204 |

FOREIGN PATENT DOCUMENTS

| | | | |
|---|---|---|---|
| 2118277 | 4/1972 | Fed. Rep. of Germany | 333/202 |

*Primary Examiner*—Marvin L. Nussbaum

*Attorney, Agent, or Firm*—Joan Pennington; James W. Gillman; Edward M. Roney

[57] ABSTRACT

The invention is directed to a interdigital filter comprising a plurality of conductive strips positioned in a row and electromagetically coupled to one another. A conductive transmission line is positioned with respect to the row of conductive strips such that the two ends of the transmission line are capacitively coupled to the ungrounded ends of two nonadjacent conductive strips. This arrangement gives the frequency response of the filter a transmission zero. The frequency of the transmission zero can be adjusted by trimming the ends of the conductive transmission line so as to effect the capacitive coupling between the non-adjacent strips.

3 Claims, 6 Drawing Figures

IMPLEMENTATION OF A TUNABLE TRANSMISSION ZERO ON TRANSMISSION LINE FILTERS

BACKGROUND OF THE INVENTION

This invention generally relates to transmission line filters and more particularly to interdigital stripline filters having a tunable low side transmission zero.

The interdigital filter is a particular type of transmission line filter. Its application to different type filter constructions is well known in the art of electromagnetic filter design. The invention is disclosed in connection with a stripline interdigital filter. They are small sized filters which can be implemented at low cost.

A stripline filter is a modification of the basic resonant cavity. The stripline filter makes use of a series of flat conductive strips placed within a square or rectangular grounded cavity or between two ground planes. Electical coupling between the conductive strips is achieved by means of fringing electromagnetic fields associated with each strip. The fringing electromagnetic field of a single strip affect adjacent strips to a degree dependent upon the physical distance between two two adjacent strips. Each conductive strip defines a pole in the transfer function of the stripline filter. In such filters, the exact frequency of the pole depends upon the relative configuration of the conductive strips which compose the filter and the dielectric constant of the material occupying the space between the strips.

Stripline filters have long been known to have uses in miniature electronic devices, especially high frequency communication equipment. Quite often, stripline filters are used as front end filters in UHF communication devices. The function of a front end filter is to pass the desired signal frequency and attenuate all other frequencies, particularly the image frequency produced in the mixer of a receiver.

In the field of communications electronics there is a great concern about the effect of the image frequency on the standard superheterodyne receiver. The image frequency is an electromagnetic signal at a particular frequency that can cause interference problems in a superheterodyne receiver. The mechanism whereby image production takes place may be explained in the following manner: When two signals are combined, as they are in a receiver mixer, one of arbitrary frequency f (the received signal), and the other of constant frequency $f_{LO}$ (internal signal), resultant signals are produced at the sum and difference frequencies, $f+f_{LO}$ and $f-f_{LO}$. Of concern are only those frequencies, f, which differ from $f_{LO}$ by a predetermined frequency called the intermediate frequency or $f_{IF}$. There are two frequencies f which have this special relationship, $f_1=f_{LO}+f_{IF}$ and $f_2=f_{LO}-f_{IF}$. As a result, without a front end filter a receiver's mixer will produce a resultant signal on frequency $f_{IF}$ which is equally strong for received signals at both $f_1$ and $f_2$. Hence either of these two signal frequencies may be picked as the signal on which the desired information is encoded. Once $f_1$ or $f_2$ is chosen, signals on the unchosen frequency ($f_2$ or $f_1$) constitute an interference if the response to the unchosen signal is not eliminated by the front end filter before it reaches the receiver mixer. The signal, $f_1$ or $f_2$, which is not encoded with the desired information is commonly called the image signal at the image frequency. The problem of elimination of the response of the superheterodyne radio to the image signal and its relation to the invention is more fully explained in connection with FIGS. 1 and 2.

Stripline filters, as used in UHF communication equipment for front end filters, are particularly important for attenuating the undesirable image frequency. The amount of attenuation at the image frequency is commonly called the image protection of the receiver and it is usually specified in decibels. The performance of the front end filter can be very important since it almost entirely determines the quality of the image protection in a receiver.

An important consideration in front end filter design is the selectivity, and the insertion loss of the filter at the resonant frequency. Increased selectivity in a stripline filter, necessarily increases the image protection. Normally, to increase the selectively of a interdigital filter the conductive strips of the stripline filter must be repositioned or additional quarter wavelength strips must be added to the existing filter. Either approach results in an increase of the characteristic insertion loss of the stripline filter. In a particular communications application, if a high degree of selectivity is demanded of the front end filter performance, then the system specification must be satisfied with a certain amount of insertion loss in the filter. As a result of this, the degree of attenuation of the image frequency is limited by the amount of insertion loss in the stripline filter which can be tolerated by the overall system. Therefore, precise control of the attenuation of the image frequency using a stripline filter was possible only by accepting less rigorous requirements in other aspects of the filter design.

Usually when both selectivity and insertion loss are subject to rigid requirements in a system design, the designer must abandon the use of stripline filters and resort to the more expensive and larger helical resonators in order to achieve the front end filter performance demanded by the system. Such a switch in front end filter design has in the past been unavoidable when a certain combination of high performance characteristics are required. This design modification is undesirable since stripline filters are much cheaper to manufacturer and much more reliable than the cumbersome construction of the helical resonators. Moreover, helical resonators are difficult to reproduce accurately, whereas stripline filters can be reproduced with great accuracy through the use of the well-known process of photolithography.

It is in this respect that the stripline filters in the prior art have been inadequent to give the design engineer flexibility in the implementation of a front end filter in a communications device. The addition of tunable transmission zeros in the transfer function of a stripline filter would considerably increase the flexibility of a stripline filter in virtually all applications by allowing an increase in attenuation at a selected frequency (preferably the image frequency) without a prohibitive increase in insertion loss.

Therefore, it is an object of this invention to provide a transmission line filter with improved attenuation at a selected frequency.

Additionally, it is also an object of this invention to provide one or more tunable transmission zeros in a interdigital filter to increase the quality of the attentuation performance of a interdigital filter comprising three or more quarter wavelength conductive strips.

SUMMARY OF THE INVENTION

Briefly, the invention is related to a transmission line filter, preferably an interdigital filter, with a tunable transmission zero. The filter described herein is a stripline interdigital filter comprising a plurality of conductive strips sandwiched between a first and second portion of a dielectric material. Each dielectric portion is substantially rectangular in shape with a top, bottom and four sides. The bottom sides of the first and second dielectric portions are each covered by a ground plane which serves as a electromagnetic shield for the plurality of conductive strips. A conductive channel, having a conductive pad on both of its longitudinal ends, is etched out of either the first or second ground plane. The two pads of the conductive channel are positioned directly over the ungrounded ends of two non-adjacent conductive strips. This construction and physical arrangement of the two pads results in two series connected parallel plate capacitors connecting the ungrounded ends of the two non-adjacent conductive strips, thus giving the filter a frequency response transmission zero at some frequency below the resonant frequency of the filter. The exact frequency of the transmission zero can be adjusted by trimming the two pads through the use of a laser or an abrasive.

DESCRIPTION OF THE PREFERRED EMBODIMENT

Figure 1:
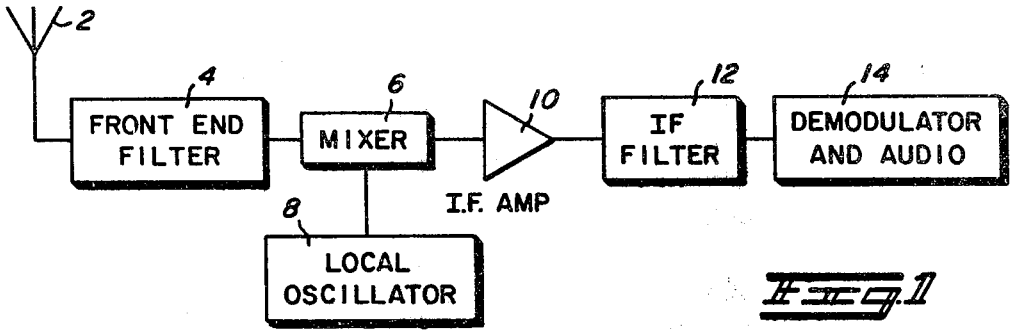
FIG. 1 is a block diagram of a conventional communications superheterodyne receiver.

FIG. 1 shows a block diagram of a typical receiver system which may advantageously utilize the stripline filter of the instant invention. An electromagnetic signal received by antenna 2 is directed to the front end filter 4. The front end filter is intended to pass the desired frequencies while attenuating other frequencies. It is well known that stripline filters are desirable components for the front end filter when operation is in the UHF range. The filter signal is applied to the mixer 6 where the signal is combined with a frequency from a local oscillator 8. While the desired information signal from the front end filter is usually a UHF signal, the signal from local oscillator 8 is a UHF frequency offset by an IF or intermediate frequency. The beat signal from mixer 6 is amplified by amplifier 10. Then the unwanted mixing signals are removed by IF filter 12 and the information carrying IF signal, is delivered to a demodulator or audio converter 14.

Figure 2:
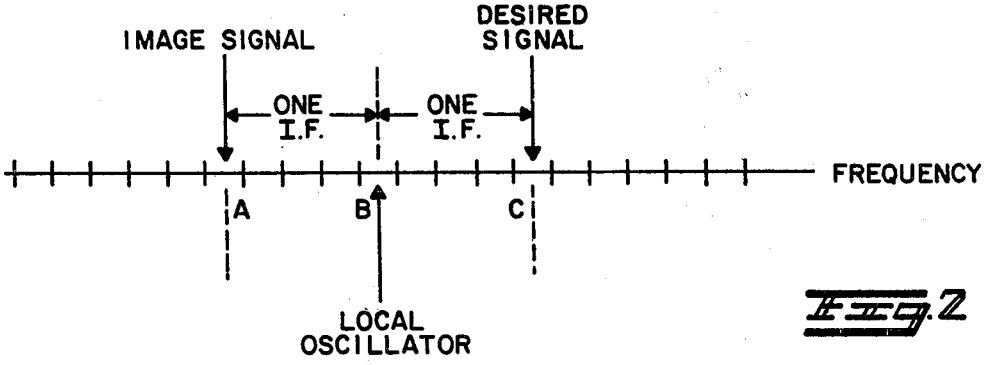
FIG. 2 is a frequency chart showing the relationship between a local oscillator frequency, signal frequency, image frequency and the intermediate or IF frequency.

FIG. 2 is a frequency chart demonstrating the relative spectrum location of the frequency of local oscillator 8 with respect to the two signals that can be simultaneously located one IF from the local oscillator frequency. FIG. 2 illustrates the problem inherent to all mixing systems, that of an image response. For communications applications, an operator receiving transmitted signals on both the desired and image frequencies typically wants to detect and demodulate only one of the frequencies. Since the mixer 6 cannot discriminate between the IF signal from the desired signal and the IF signal from the image frequency, filtering must be utilized to separate the desired signal from the image signal. A front end filter 4 discriminates against the image signal and also prevents other unwanted out-of-band signals from possibly overloading the receiver mixer 6.

As can be seen from an inspection of FIG. 2, if local oscillator 8 has a frequency B it will properly mix with both information signals A and C, respectively located one IF below and one IF above frequency B of the local oscillator 8. Without a front end filter 4, if both signals A and C are present, both will appear simultaneously at the output of the mixer. The unwanted signal is always one IF above or below the local oscillator frequency B. Therefore if the desired signal is chosen to be the frequency one IF above the local oscillator (frequency C) then, for the reasons previously stated, the signal one IF below the local oscillator (frequency A) must be effectively attenuated by the front end filter 4.

Front end filters must define a frequency response characteristic that has a band pass at the frequency of the desired signal (frequency C in FIG. 2). Each conducive strip defines a pole in the transfer function of the filter. By arranging the relative positioning of the conductive strips in a stripline filter, a frequency response characteristic can be created which has its poles at the signal frequency. The three decibel bandwidth of the filter can be modified by making well known adjustments in the filter design. A wider bandwidth reduces the insertion loss of the filter but it also reduces the filter's attenuation at the image frequency. The addition of a transmission zero in the transfer function at the frequency of the unwanted signal (frequency A) could effectively improve the performance of an existing stripline filter.

Figure 3:
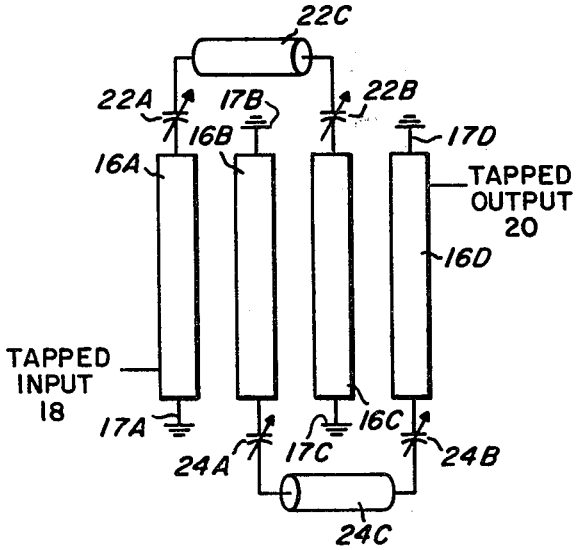
FIG. 3 is a schematic diagram of a stripline filter with a tunable low side transmission zero in accordance with the invention.

FIG. 3 is an electrical diagram representing the electrical characteristics of the stripline filter according to the invention. The filter resonators are comprised of conductive strips 16*a*, 16*b*, 16*c* and 16*d* which are each approximately a quarter wavelength long. FIG. 3 shows four conductive strips but the invention can be applied to any three or more plurality of strips. Each conductive strip is physically adjacent to other conducting strips in the filter. Coupling between the strips is achieved thru the fringing electromagnetic fields associated with each strip. Each strip is grounded at a longitudinal end shown as 17*a*–17*d* in FIG. 3. The grounded longitudinal end of each strip 16*a*–16*d* is opposite the grounded longitudinal end of an adjacent strip. The strips are aligned in a row and in a substantially parallel arrangement with respect to their longitudinal axes. A tapped input 18 and a tapped output 20 are conventional input-output arrangements for a stripline filter. The physical distance between adjacent strips determines the electromagnetic coupling between the strips. The variable design parameters that can be achieved by varying the construction dimensions of the stripline filter are well known in the art.

A first tunable transmission zero in the transfer function of the stripline filter of FIG. 3 is provided by the coupling of two nonadjacent strips 16*a* and 16*c* at their ungrounded longitudinal ends by conductive transmission line 22 comprising a series of a first variable capacitor 22*a*, a transmission line 22*c* and a second variable capacitor 22*b*. A second tunable transmission zero is created by the coupling of the second and fourth conductive strips, 16*b* and 16*d* respectively, at their ungrounded longitudinal ends. A conductive transmission line 24 comprising a series connected first variable capacitor 24*a*, a transmission line 24*c* and a second variable capacitor 24*b* connect the ungrounded longitudinal ends of the conductive strips 16*b* and 16*d* of the stripline filter. By adjusting the value of the series connected variable capacitors, the transmission zero of the filter can be precisely selected. The two tunable transmission zeros as shown in FIG. 3 can be tuned to the same zero transmission frequency thus allowing each added transmission zero to significantly increase the attenuation of a single selected frequency.

Figure 4:
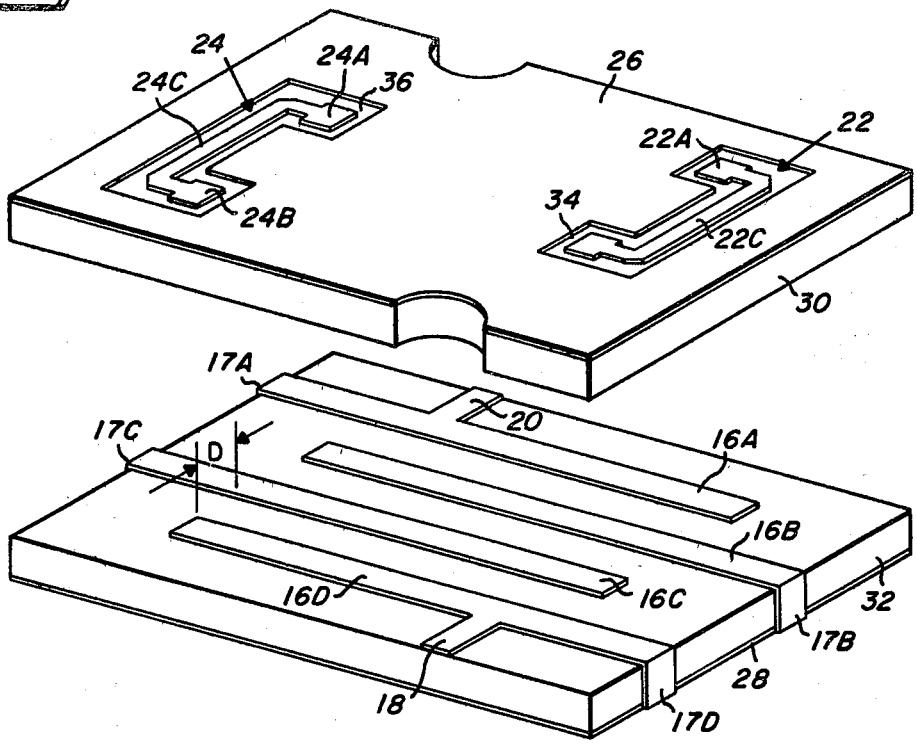
FIG. 4 is an elevated exploded view of the physical construction of a stripline filter having a tunable low side transmission zero in accordance with the invention.

FIG. 4 shows an elevated perspective view of the physical structure of the stripline filter according to the invention. The filter comprises first and second conductive grounded surfaces 26 and 28 which sandwich a first dielectric layer 30, a layer of conductive strips comprising elements 16*a*, 16*b*, 16*c*, 16*d*, 18 and 20 and a second dielectric layer 32. The first or top conductive grounded surface 26 includes two conductive transmission lines or conductive channels 22 and 24 created by etching away a portion of the conductive grounded surface 26 to form insulating boundary layers 34 and 36 between the conductive grounded surface 26 and the conductive channels 22 and 24 respectively. The conductive channels 22 and 24 are the physical element which allow the stripline filter to implement a tunable transmission zero in its characteristic frequency transfer function. Conductive channels 22 and 24 are each composed of three parts; two pads connected by a transmission line. Accordingly pads 22*a* and 22*b* and transmission line 22*c* comprise conductive channel 22 and similarly pads 24*a* and 24*b* and transmission line 24*c* comprise conductive channel 24. Each pad forms a parallel plate capacitor with the ungrounded end of one of the conductive strips 16*a*–16*d*. By connecting two pads, the transmission lines 22*c* and 24*c* create a capacitive connection between two non-adjacent conductive strips.

Below the top conductive grounded surface 26 in FIG. 4 is a first dielectric material 30. The material can be any dielectric that is suitable to support the sandwich construction of the filter. Air could be utilized as a dielectric if the ground planes and filter conductive strips are constructed to receive physical support by some means other than the dielectric. Such construction is well known in the art. Of course, if air is used as the dielectric, then some well known process other than photolithography may be employed to construct the conductive strips.

Beneath the first portion of dielectric material 30 are the conductive strips 16*a*–16*d* with tapped input 18 and tapped output 20. Alternating ends of adjacent strips in the row of conductive strips 16*a*–16*d*, shown as 17*a*–17*d* in FIG. 4, are grounded to either of the two conductive grounded surfaces 26 or 28. In FIG. 4, conductive strip ends 17*a*–17*d* are grounded to grounded surface 28. As mentioned in connection with FIG. 3, the conductive strips 16*a*–16*d* are approximately one quarter wavelength long. They are positioned in a single row with their longitudinal axis parallel to one another. The row may define a plane which is substantially parallel with both conductive grounded surfaces 26 and 28. The physical distance D between adjacent strips 16*a*–16*d* plays a well known part in determining the nature of the coupling between the strips of the filter. Below the conductive strips 16*a*–16*d*, input 18 and output 20 there is a second dielectric material 32 followed by a second conductive grounded surface 28 which together with the top conductive grounded surface 26 serve to provide the stripline filter with an electromagnetic shield. It should be mentioned that one or both of the conductive channels 22 and 24 could be etched out of conductive grounded surface 28 instead of conductive grounded surface 26 since the stripline filter is symmetrical for this purpose.

In the preferred embodiment the dielectric material 30 and 32 are composed of a ceramic having a high dielectric constant. Each piece of dielectric material is substantially shaped as a rectangle with a top, bottom and four sides. The top and bottom sides of dielectric 30 and 32 are metalized by conventional methods. On the top side of each dielectric the conductive strips are preferably etched out of the layer of metal using a conventional photolithographic process. The pattern etched onto one dielectric material is the mirror image of the pattern etched on the other. At least one conductive channel is etched out of the bottom side of either dielectric 30 or 32, also by a conventional photolithographic process. The particular position of the conductive transmission lines 22 or 24 in the conductive grounded surfaces 26 or 28 that results in the conductive channels creating a parallel plate capacitor with the ungrounded ends of conductive strips 16*a*–16*d* is described in connection with FIG. 5. The two dielectrics 30 and 32 are physically joined by soldering together the two conductive strip patterns on the dielectric material, thus forming one transmission line filter.

Figure 5:
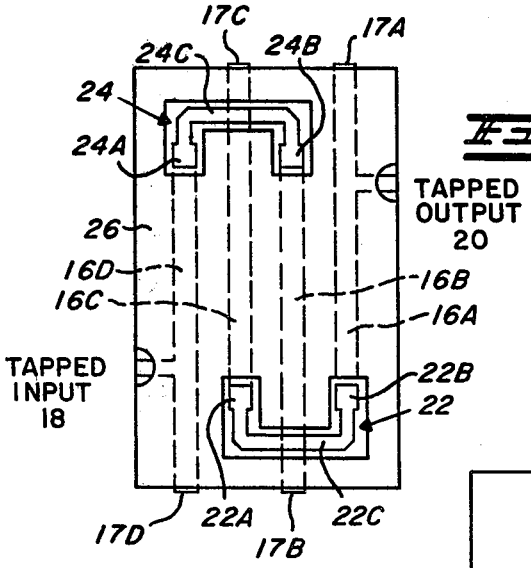
FIG. 5 is a plan view of the stripline filter shown in FIG. 4.

FIG. 5 is a plan view of the stripline filter of FIG. 4. The dashed line segments represent the conductive strips 16*a*–16*d* which are under the first or top conductive grounded surface 26 and dielectric material 30 as shown in FIG. 4. FIG. 5 shows the relative physical arrangement of the conductive channels 22 and 24 in the plane of conductive grounded surface 26 with respect to the plane defined by the row of conductive strips 16*a*–16*d*. Pads 22*a* and 22*b* each form, together with the ungrounded ends of the two conductive strips 16*a* and 16*c*, a parallel plate capacitor connected by the transmission line 22*c* which joins the two pads. In the same manner pads 24*a* and 24*b* each form a capacitor with conductive strips 16*b* and 16*d* respectively. By laser trimming the pads and the capacitive coupling between the pads and conductive strips can be varied in order to precisely choose the zero frequency. Other means, such as an abrasive, can also be used to trim the pads.

Figure 6:
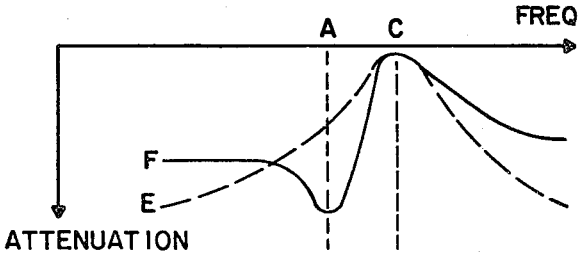
FIG. 6 is a graph illustrating the improved attenuation achieved by the addition of a tunable low side transmission zero to a stripline filter in accordance with the invention in comparison with the frequency response of the prior art stripline filter.

FIG. 6 shows a graph of attenuation versus frequency for both a prior art stripline filter and a stripline filter incorporating the invention. The dotted line E represents the frequency response of the prior art stripline filter while the solid line F represents the frequency response of a stripline filter having at least one tunable transmission zero (i.e. at least one capacitor, transmission line, and capacitor connection). As evidenced by the graph of FIG. 6, a tunable low side zero can substantially improve the attenuation of an image frequency without a noticeable increase in insertion loss at the filter's resonant frequency. It should be noted that the addition of the tunable transmission zero to the stripline filter causes a degradation in attenuation at frequencies above the filter's resonant frequency. But since the image frequency is always below the resonant frequency of the filter for an arrangement such as that shown in FIGS. 1 and 2, the slight decrease in attenuation above the resonant frequency of the filter is not a serious concern. As FIG. 6 indicates, the unwanted image frequency (frequency A from FIG. 2) is much more effectively attenuated by the stripline filter utilizing the invention described herein.

In an alternate embodiment for an interdigital filter with a tunable transmission zero, the conductive channels 22 and 24 can be etched onto the same substrate with the conductive strips 16*a*–16*d*. Such a construction would give exactly the same performance as the configuration of the preferred embodiment. If the interdigital filter of this alternate embodiment were a stripline filter, it could not be easily tuned since there would be a dielectric on both sides of the conductive channel. A microstrip filter using the alternate embodiment could be easily tuned since the dielectric material would be on only one side of the conductive channel thus leaving the conductive channel exposed as that it can be easily trimmed.

In summary, the transmission line filter of the invention provides an improved selectivity without sacrificing low insertion loss by implementing a tunable low side transmission zero in the frequency response of the filter.

I claim:

1. A transmission fine filter having at least three poles and one zero in its frequency transfer function, said filter comprising;

a row of a plurality of conductive strips which define resonators having at least three poles;

a conductive grounded surface spaced from said row of a plurality of conductive strips with said conductive grounded surface cooperating with said plurality of conductive strips to form a transmission line filter; and a transmission zero means capacitively coupled to at least two of said plurality of conductive strips with said frequency zero means being a conductive transmission line etched out of said conductive grounded surface.

2. A transmission line filter in accordance with claim 1, further including a first and second dielectric each having a first and second side with said first sides mated together and said plurality of conductive strips positioned between said first and second dielectric; said conductive ground plane positioned on said first dielectric second side and a second conductive ground plane positioned on said second dielectric second side.

3. In a transmission line filter having a row of a plurality of conductive strips with a grounded end and a ungrounded end and defining a row of resonators and a conductive grounded surface separated from said row and cooperating with said plurality of conductive strips to form a transmission line filter, the method of creating a tunable zero in the filter frequency response including the steps of;

(a) forming an isolated transmission line such that said isolated transmission line has its two longitudinal ends capacitively coupled to the ungrounded ends of two non-adjacent conductive strips; and (b) trimming each of said two longitudinal ends of said isolated transmission line so as to affect said capacitive coupling and to thereby tune the filter to a desired zero transmission frequency.

* * * * *